United States Patent [19]

Sugiura et al.

[11] Patent Number: 4,488,524

[45] Date of Patent: Dec. 18, 1984

[54] IDLING SPEED CONTROL FOR ENGINES

[75] Inventors: Kengo Sugiura, Anjo; Yasutaka Yamauchi, Toyota; Hiroshi Ito, Nagoya, all of Japan

[73] Assignees: Nippondenso Co., Ltd., Kariya; Toyota Jidosha Kabushiki Kaisha, Toyota, both of Japan

[21] Appl. No.: 402,807

[22] Filed: Jul. 28, 1982

[30] Foreign Application Priority Data

Aug. 1, 1981 [JP] Japan ..... 56-120808

[51] Int. Cl.[3] ..... F02D 1/04; F02B 3/00

[52] U.S. Cl. ..... 123/339; 123/327; 123/585; 123/489

[58] Field of Search ..... 123/339, 327, 587, 585, 123/489

[56] References Cited

U.S. PATENT DOCUMENTS

| | | | |
|---|---|---|---|
| 4,237,833 | 12/1980 | Des Lauriers | 123/339 |
| 4,237,838 | 12/1980 | Kinugawa et al. | 123/339 |
| 4,306,527 | 12/1981 | Kinugawa et al. | 123/339 |
| 4,364,348 | 12/1982 | Itoh et al. | 123/339 |
| 4,378,767 | 4/1983 | Kobashi et al. | 123/339 |

*Primary Examiner*—Raymond A. Nelli

*Attorney, Agent, or Firm*—Cushman, Darby & Cushman

[57] ABSTRACT

In or idling speed control system for engines, a bypass passage is branched off from a main intake passage located upstream of a throttle valve and is connected to the main intake passage located downstream of the throttle valve. A flow control valve, actuated by a step motor, is arranged in the bypass passage. The step motor is controlled by an electronic control unit so that the engine speed becomes equal to a predetermined speed. When the engine is stopped, the flow control valve opens the bypass passage to the maximum extent so that the engine can be easily started at the time of next engine start.

8 Claims, 16 Drawing Figures

REVOLUTION SIGNAL
US/UB
THW
THA
A/CT
IG S/W
STA
NSW
Idℓ
PSW
A/C
IGf
MPU
200
ADC
207
INPUT PORT
204
206
ROM
201
RAM
202
BACK-UP RAM
203
OUTPUT PORT
205
DRIVE CIRCUIT
210
DRIVE CIRCUIT
DRIVE CIRCUIT
DRIVE CIRCUIT
208
M-REL
S1 S2
E1 E2

IDLING SPEED CONTROL FOR ENGINES

BACKGROUND OF THE INVENTION

The present invention relates to an idling speed control for engines, and particularly enabling to start the engine easily after the engine is stopped.

An idling speed control device has been known in which a bypass passage is branched off from the intake passage of an engine, which is located upstream of a throttle valve, and connected again to the intake passage located downstream of the throttle valve, and a diaphragm type vacuum operated control valve device is arranged in the bypass passage. The diaphragm vacuum chamber of the control valve device is connected via a vacuum conduit to the intake passage located downstream of the throttle valve, and an electromagnetic control valve is arranged in the vacuum conduit for controlling the cross-sectional area of the vacuum conduit. In this idling speed control device, at the time of idling, the level of the vacuum produced in the diaphragm vacuum chamber of the control valve device is controlled by controlling the electromagnetic control valve in accordance with the operating condition of the engine. In addition, the air flow area of the bypass passage is controlled in accordance with a change in the level of the vacuum produced in the diaphragm vacuum chamber. As a result of this, the amount of air fed into the cylinders of the engine from the bypass passage is controlled. However, in such a conventional idling speed control device, since the diaphragm type vacuum operated control valve device is used, the controllable range of the air flow area of the bypass passage is very narrow. Therefore, even if the control valve device is fully opened, the amount of air which is necessary to operate the engine at the time of fast idling, cannot be fed into the cylinders of the engine from the bypass passage. Consequently, in a conventional idling speed control device, an additional bypass passage is provided in addition to the regular bypass passage, and a valve, which is actuated by a bimetallic element, is arranged in the additional bypass passage. When the temperature of the engine is low, the valve, which is actuated by the bimetallic element, opens. As a result of this, since additional air is fed into the cylinders of the engine from the additional bypass passage, in addition to the air fed into the cylinders of the engine from the regular bypass passage, the amount of air which is necessary to operate the engine at the time of fast idling, can be ensured. However, as mentioned above, in a conventional idling speed control device, since the amount of air fed into the cylinders of the engine is controlled by only the expanding and shrinking action of the bimetallic element at the time of fast idling, there is a problem in that it is impossible to precisely control the amount of air fed into the cylinders of the engine. In addition, in such a conventional idling speed control device, another problem occurs in that, when the engine is started, it is difficult to feed air into the cylinder of the engine in an amount which is sufficient to start the engine, and that particularly, when the engine is started again immediately after the engine is stopped, since the amount of air fed into the cylinder of the engine becomes very small relative to the amount of air which is necessary to start the engine, a good starting operation of the engine cannot be obtained.

SUMMARY OF THE INVENTION

An object of the present invention is to provide an idling speed control device capable of eliminating the above-mentioned problems. That is, the object of the present invention is to easily start the engine again by controlling the position of the flow control valve in the bypass passage so that the amount of air flowing within the bypass passage becomes maximum or becomes an amount determined by the engine temperature when the engine speed is reduced below a predetermined speed indicating that the engine will be stopped.

According to the present invention, there is provided a device, for controlling the idling speed of an engine comprising a main intake passage, a throttle valve arranged in the main intake passage, a bypass passage branching off from the main intake passage upstream of the throttle valve and being connected to the main intake passage downstream of the throttle valve, and a control valve arranged in the bypass passage, said device comprising: means for actuating the control valve to control the flow area of the bypass passage; first means for detecting an engine speed to produce an output signal indicating the engine speed; second means for detecting the operating condition of the engine to produce an output signal indicating that the engine is idling; and control means controlling said actuating means to actuate the control valve in response to the output signals of said first means, and said second means for equalizing the engine speed to a predetermined speed at the time of idling and for equalizing the flow area of the bypass passage to a predetermined desired flow area when the engine speed is reduced below a predetermined speed which cause the engine to stop.

The present invention may be more fully understood from the description of preferred embodiments of the invention set forth below, together with the accompanying drawings.

DESCRIPTION OF PREFERRED EMBODIMENTS

Figure 1:
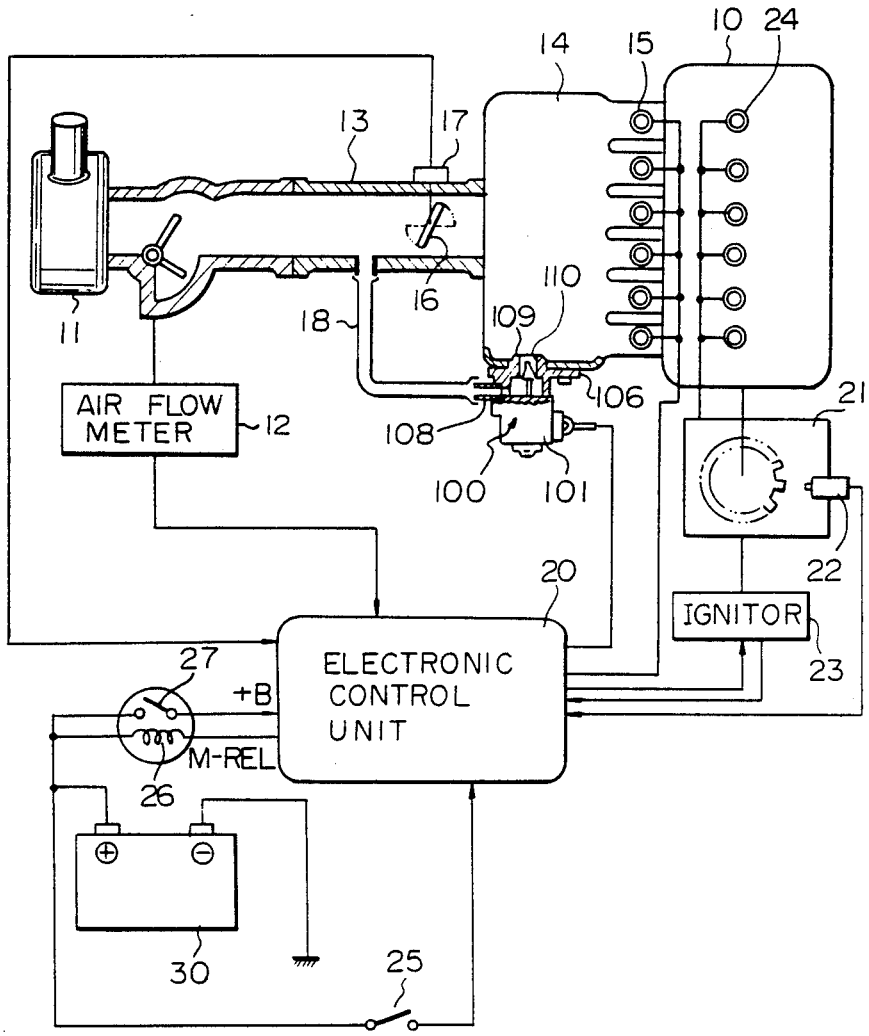
FIG. 1 is a partial cross-sectional view of an intake system equipped with an idling speed control device according to the present invention.

Referring to FIG. 1, 10 designates a spark-ignition-type 4-cycle engine mounted on a load vehicle, 11 an air cleaner, 12 an air flow meter, 13 an intake duct, 14 a surge tank having a plurality of branch pipes, and 15 fuel injectors arranged on the corresponding branch pipes of the surge tank 14. Main air is fed into the cylinders of the engine 1 via the air cleaner 11, the air flow meter 12, the intake duct 13, the surge tank 14, and the branch pipes of the surge tank 14, and fuel is injected from the fuel injectors 15 into the main air during a time period determined by an electronic control unit 20. The amount of main air is controlled by a throttle valve 16 which is operated by the accelerator pedal (not shown). A throttle sensor 17 is connected to the throttle valve 16 and comprises an idle switch (IDL) for detecting the completely closed state of the throttle valve 16 and a power switch (PSW) for detecting the fully opened state of the throttle valve 16. The idle switch IDL and the power switch PSW are connected to the electronic control unit 20. An electromagnetic pickup 22, functioning as an engine-speed sensor, is arranged in a distributor 21, and the engine speed signal, issued from the electromagnetic pickup 22, is input into the electromagnetic control unit 20.

An ignitor 23 produces an ignition signal on the basis of the output signal of the electronic control unit 20. This ignition signal is fed into spark plugs 24 via the distributor 21, and thereby, ignition is carried out. In addition, signals (IGF) indicating whether a high voltage is applied to the distributor 21 are input into the electronic control unit 20 from the ignitor 23. Power is supplied to the electronic control unit 20 by turning the ignition switch 25 on. When the ignition switch 25 is turned on, electric current is fed into a coil 26 on the basis of the output signal M-REL of the electronic control unit 20. Thus, the main relay switch 27 is turned on. This main relay switch 27 remains on for a little while after the ignition switch 25 is turned off so that power can be supplied to the electronic control unit 20 after the ignition switch 25 is turned off.

Figure 2:
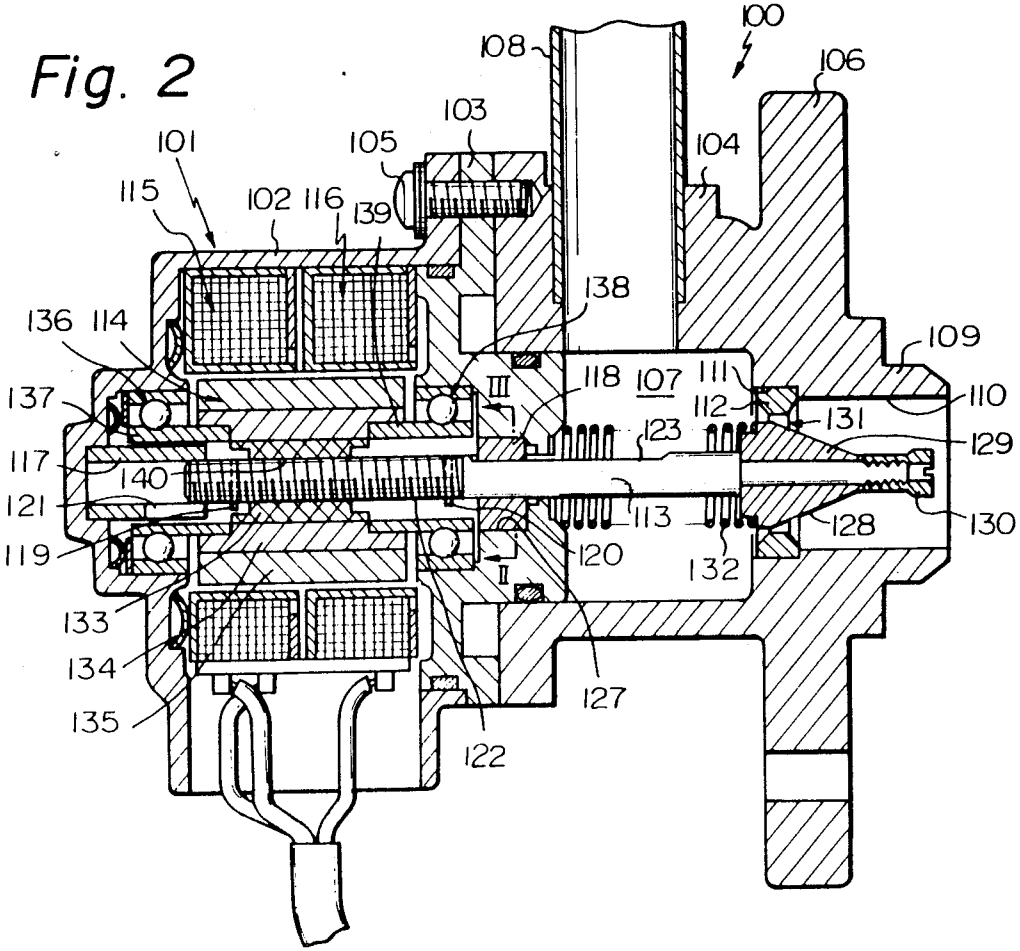
FIG. 2 is a cross-sectional side view of a flow control valve device.

A flow control valve device 100 is mounted on the surge tank 14. As illustrated in FIG. 2, the flow control valve device 100 comprises a motor housing 102 supporting a step motor 101, a motor housing end plate 103, and a valve housing 104. The motor housing 102, the end plate 103, and the valve housing 104 are interconnected to each other by means of bolts 105. As illustrated in FIGS. 1 and 2, a flange 106 is formed in one piece on the valve housing 104 and is fixed onto the outer wall of the surge tank 14 by means of bolts. A valve chamber 107 is formed in the valve housing 104 and is connected via an air conduit 18 and a bypass pipe 108, fixed onto the valve housing 104, to the inside of the intake duct 13, which is located upstream of the throttle valve 16. In addition, a hollow cylindrical projection 109, projecting into the surge tank 14, is formed in one piece on the side wall of the flange 106, and a cylindrical air outflow bore 110 is formed in the hollow cylindrical projection 109. An annular groove 111 is formed on the inner end of the air outflow bore 110, and a valve seat 112 is fitted into the annular groove 111.

Figure 3:
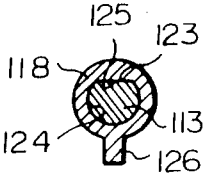
FIG. 3 is a cross-sectional view taken along the line III—III in FIG. 2.
Figure 4:
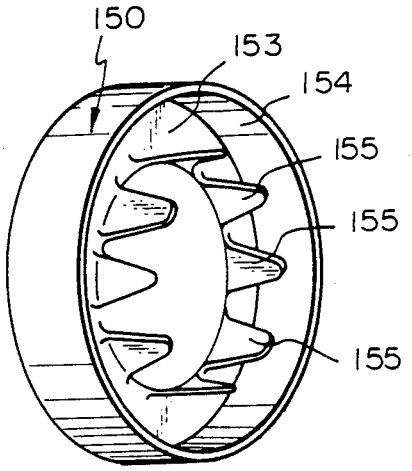
FIG. 4 is a perspective view of a stator core member.
Figure 5:
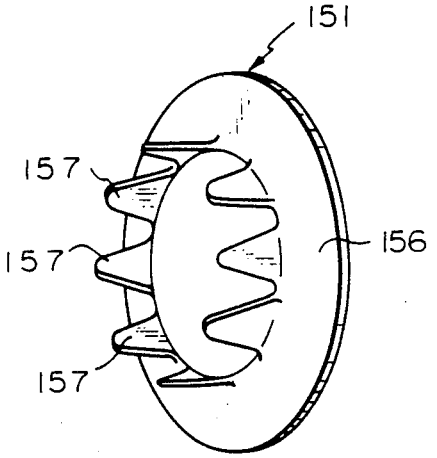
FIG. 5 is a perspective view of a stator core member.

As illustrated in FIG. 2, the step motor 101 comprises a valve shaft 113, a rotor 114 coaxially arranged with the valve shaft 113, and a pair of stators 115, 116, each being stationarily arranged in the motor housing 102 and spaced a slight distance from the cylindrical outer wall of the rotor 114. The end portion of the valve shaft 113 is supported by a hollow cylindrical bearing 117 made of a sintered metal and fixed onto the motor housing 102, and the intermediate portion of the valve shaft 113 is supported by a hollow cylindrical bearing 118 made of a sintered metal and fixed onto the end plate 103. A first stop pin 119, which abuts against the rotor 114 when the valve shaft 113 reaches the most advanced position, is fixed onto the valve shaft 113, and a second stop pin 120, which abuts against the rotor 114 when the valve shaft 113 reaches the most retractable position, is fixed onto the valve shaft 113. In addition, an axially extending slot 121, into which the first stop pin 119 is able to enter, is formed in the bearing 117. External screw threads 122 are formed on the outer circumferential wall of valve shaft 113, which is located within the motor housing 102. The external screw threads 122 extend towards the right in FIG. 2 from the left end of the valve shaft 113 and terminate a slight distance from where the valve shaft 113 passes through the second stop pin 120. In addition, an axially extending flat portion 123, which extends towards the right in FIG. 2 from a position near the terminating position of the external screw threads 122, is formed on the outer circumferential wall of the valve shaft 113. As illustrated in FIG. 3, the inner wall of the shaft-bearing hole of the bearing 118 comprises a cylindrical wall portion 124 and a flat wall portion 125 which have a complementary shape relative to the outer circumferential wall of the valve shaft 113. Consequently, the valve shaft 113 is supported by the bearing 118 so that the valve shaft 113 cannot be rotated but is capable of sliding in the axial direction. In addition, as illustrated in FIG. 3, an outwardly projecting arm 126 is formed in one piece on the outer circmferential wall of the bearing 118, and a bearing-receiving hole 127 (FIG. 2), having a contour shape which is the same as that of the bearing 118, is formed on the inner wall of the end plate 103. Consequently, when the bearing 118 is fitted into the bearing-receiving hole 127, as illustrated in FIG. 2, the bearing 118 is non-rotatably supported by the end plate 103. A valve head 129, having a substantially conical shaped outer wall 128, is secured onto the tip of the valve shaft 113 by means of a nut 130, and an annular air flow passage 131 is formed between the valve seat 112 and the conical outer wall 128 of the valve head 129. In addition, a compression spring 132 is inserted between the valve head 129 and the end plate 103 in the valve chamber 107.

As illustrated in FIG. 2, the rotor 114 comprises a hollow cylindrical inner body 133 made of a synthetic resin, a hollow cylindrical intermediate body 134 made of a metallic material and rigidly fitted onto the outer circumferential wall of the hollow cylindrical inner body 133, and a hollow cylindrical outer body 135 made of a permanent magnet and fixed onto the outer circumferential wall of the hollow cylindrical intermediate body 134. As will be hereinafter described, an N pole and an S pole are alternately formed on the outer circumferential wall of the hollow cylindrical outer body 135 made of a permanent magnet along the circumferential direction of the outer circumferential wall of the hollow cylindrical outer body 135. As illustrated in FIG. 2, one end of the hollow cylindrical intermediate body 134 is supported by the inner race 137 of a ball bearing 136 which is supported by the motor housing 102, and the other end of the hollow cylindrical intermediate body 134 is supported by the inner race 139 of a ball bearing 138 which is supported by the end plate 103. Consequently, the rotor 114 is rotatably supported by a pair of ball bearings 136 and 138. Internal screw threads 140, which are engaged with the external screw threads 122 of the valve shaft 113, are formed on the inner wall of the central bore of the hollow cylindrical inner body 133. Therefore, when the rotor 114 rotates, the valve shaft 113 is caused to move in the axial direction.

Figure 6:
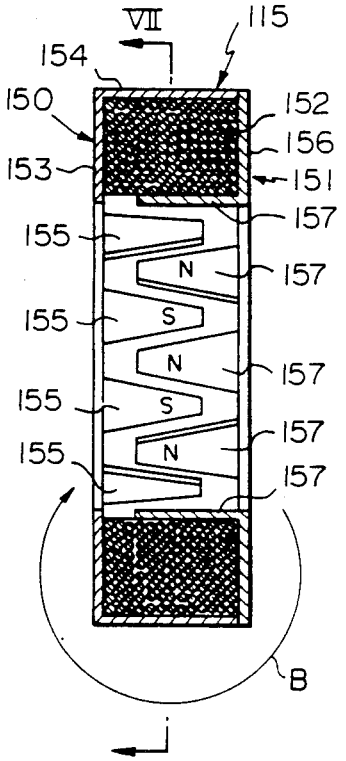
FIG. 6 is a cross-sectional side view of a stator.
Figure 7:
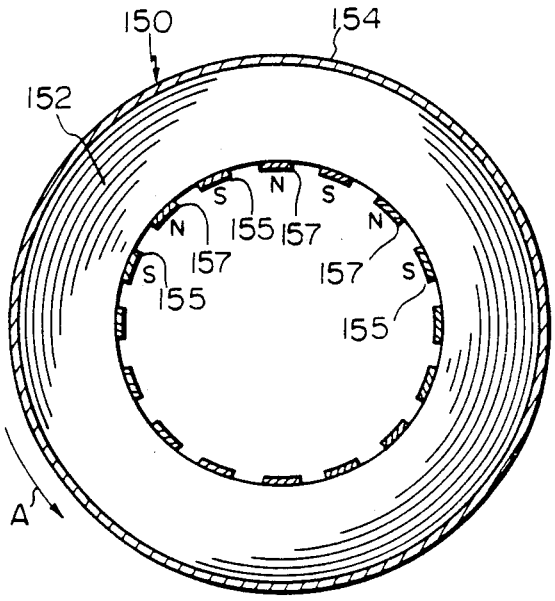
FIG. 7 is a cross-sectional view taken along the line VII—VII in FIG. 6.

The stators 115 and 116, which are stationarily arranged in the motor housing 102, have the same construction and, therefore, the construction of the stator 115 only will be hereinafter described with reference to FIGS. 4 through 7. Referring to FIGS. 4 through 7, the stator 115 comprises a pair of stator core members 150 and 151 and a stator coil 152. The stator core member 150 comprises an annular side wall portion 153, an outer cylindrical portion 154, and eight pole pieces 155 extending perpendicular to the annular side wall portion 153 from the inner periphery of the annular side wall portion 153. The pole pieces 155 have a substantially triangular shape, and each of the pole pieces 155 is spaced the same angular distance from the adjacent pole piece 155. On the other hand, the stator core member 151 comprises an annular side wall portion 156 and eight pole pieces 157 extending perpendicular to the annular side wall portion 156 from the inner periphery of the annular side wall portion 156. The pole pieces 157 have a substantially triangular shape, and each of the pole pieces 157 is spaced the same angular distance from the adjacent pole piece 157. The stator core members 150 and 151 are assembled so that each of the pole pieces 155 is spaced the same angular distance from the adjacent pole piece 157, as illustrated in FIGS. 6 and 7. When the stator core members 150 and 151 are assembled, the stator core members 150 and 151 construct a stator core. When an electric current is fed into the stator coil 152 and flows within the stator coil 152 in the direction illustrated by the arrow A in FIG. 7, a magnetic field, the direction of which is illustrated by the arrow B in FIG. 6, generates around the stator coil 152. As a result of this, the S poles are produced in the pole pieces 155, and at the same time, the N poles are produced in the pole pieces 157. Consequently, it is understood that an N pole and an S pole are alternately formed on the inner circumferential wall of the stator 115. On the other hand, if an electric current flows within the stator coil 152 in a direction which is opposite to that illustrated by the arrow A in FIG. 7, the N poles are produced in the pole pieces 157, and at the same time, the S poles are produced in the pole pieces 155.

Figure 8:
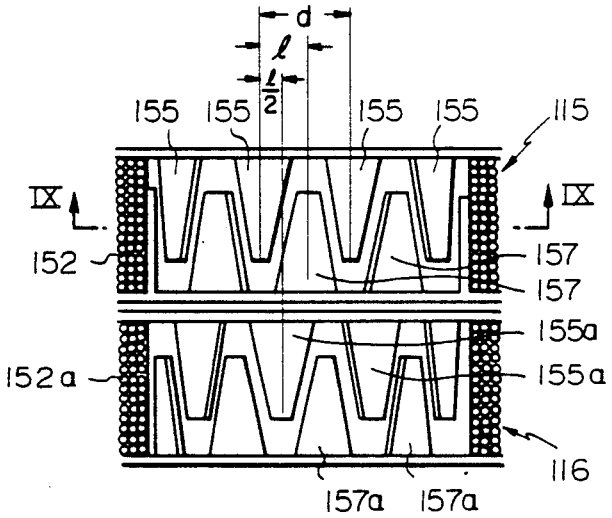
FIG. 8 is a cross-sectional plan view of the stator illustrated in FIG. 2.
Figure 9:
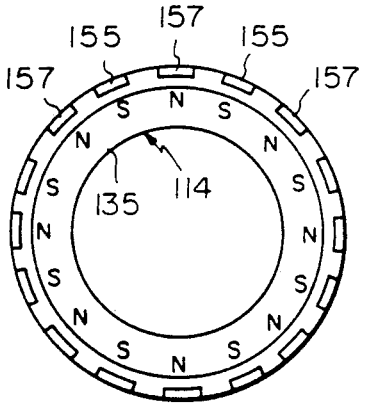
FIG. 9 is a schematic cross-sectional side view taken along the line IX—IX in FIG. 8.

FIG. 8 illustrates a case wherein the stator 115 and the stator 116 are arranged in tandem as illustrated in FIG. 2. As illustrated in FIG. 8, assuming that the distance between the pole piece 155 of the stator 115 and the adjacent pole piece 157 of the stator 115 is indicated by l, each of the pole pieces **155*a* of the stator 116 is offset by l/2 from the pole piece 155 of the stator 115, which is arranged nearest to the pole piece 155*a* of the stator 116. That is, assuming that the distance d between the adjacent pole pieces 155 of the stator 115 is one pitch, each of the pole pieces 155*a* of the stator 116 is offset by $\frac{1}{4}$ of a pitch from the pole piece 155 of the stator 115, which is arranged nearest to the pole piece 155*a* of the stator 116. On the other hand, as illustrated in FIG. 9, the N pole and the S pole are alternately formed on the outer circumferential wall of the hollow cylindrical outer body 135 of the rotor 114 along the circumferential direction of the outer circumferential wall of the hollow cylindrical outer body 135, and the distance between the N pole and the S pole, which poles are arranged adjacent to each other, is equal to the distance between the pole piece 155 and the pole piece 157 of the stator 115, which pieces 155 and 157** are arranged adjacent to each other.

Figure 10:
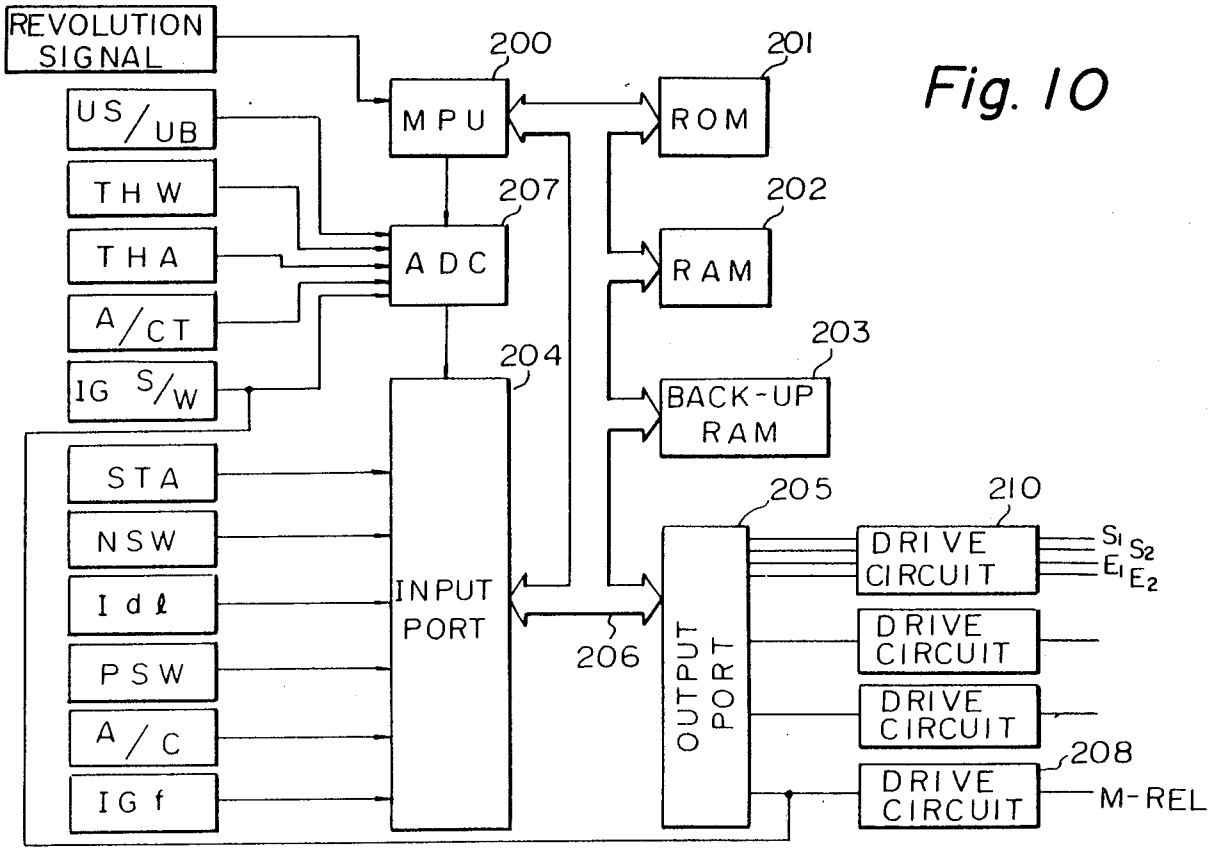
FIG. 10 is a circuit diagram of an electronic control valve.

FIG. 10 illustrates a circuit diagram of the electronic control unit 20 illustrated in FIG. 1. As illustrated in FIG. 10, the electronic control unit 20 comprises a microprocessor unit (MPU) 200 executing arithmetic and logic processing, a read-only memory (ROM) 201 storing a predetermined control program and an arithmetic constant therein, a random-access memory (RAM) 202 from which data can be read out and in which data can be written, another random-access memory (BATTERY Back-up RAM) 203 in which stored data is not erased even when the ignition switch 25 is turned OFF, an input port 204, and an output port 205. The MPU 200, the ROM 201, the RAM 202, the back-up RAM 203, the input port 204, and the output port 205 are interconnected to each other via a bidirectional bus 206. As is understood from FIG. 10, a starter signal (STA) indicating the operation of starter switch, an air conditioning signal (A/C) indicating the operation of the air conditioning switch, a neutral safety signal (NSW) indicating the operation of the neutral safety switch of the automatic transmission, a throttle close signal (IDL) indicating that the throttle valve 16 (FIG. 1) is in the completely closed state, a throttle open signal (PSW) indicating that the throttle valve 16 is in the fully opened state, and a high voltage generation signal (IGf) issued from the ignitor 23 (FIG. 1) are input into the MPU 200 via the input port 204 and the bus 206. In addition, in an AD converter (ADC) 207, an analog output signal (US/UB) of the air flow meter 12 (FIG. 1), an ignition switch signal (IG S/W) indicating voltage applied to the ignition switch 25 (FIG. 1), an output signal (THW) of the cooling water temperature sensor, an output signal (THA) of the main air temperature sensor, and an output signal (A/C T) of the evaporator outlet temperature sensor are successively converted to digital signals in a predetermined order and then are input into the MPU 200 via the input port 204 and the bus 206. Interruption is caused in the MPU 200 by the revolution signals issued from the pickup 22, and the engine speed is calculated from the time interval of the revolution signals. A step motor drive signal, a current supply to the ignitor 23, an ignition signal, a drive signal for the fuel injectors 24, and a current supply to the coil 26 are written in the output port 205 in accordance with a predetermined program by the MPU 200 and then are output from the output port 205 via drive circuits. The output port 205 is constructed as a latch. Therefore, if data is written in the output port 205 via the bus 206, the output port 025 continuously produces an output signal corresponding to the data until data indicating that the logic of the output signal of the output port 205 should be inverted is written in the output port 205 via the bus 206.

The ignition switch signal (IG S/W) is input into the input terminal of the drive circuit 208 for exciting the coil 26 of the main relay. The ignition switch signal (IG S/W) and the main relay operation signal issued from the output port 205 are supplied to the wired-OR circuit in the drive circuit 208 so that if the ignition switch 25 is on, power is supplied to the electronic control unit 20 independently of the main relay operation signal issued from the output port 205.

Figure 11:
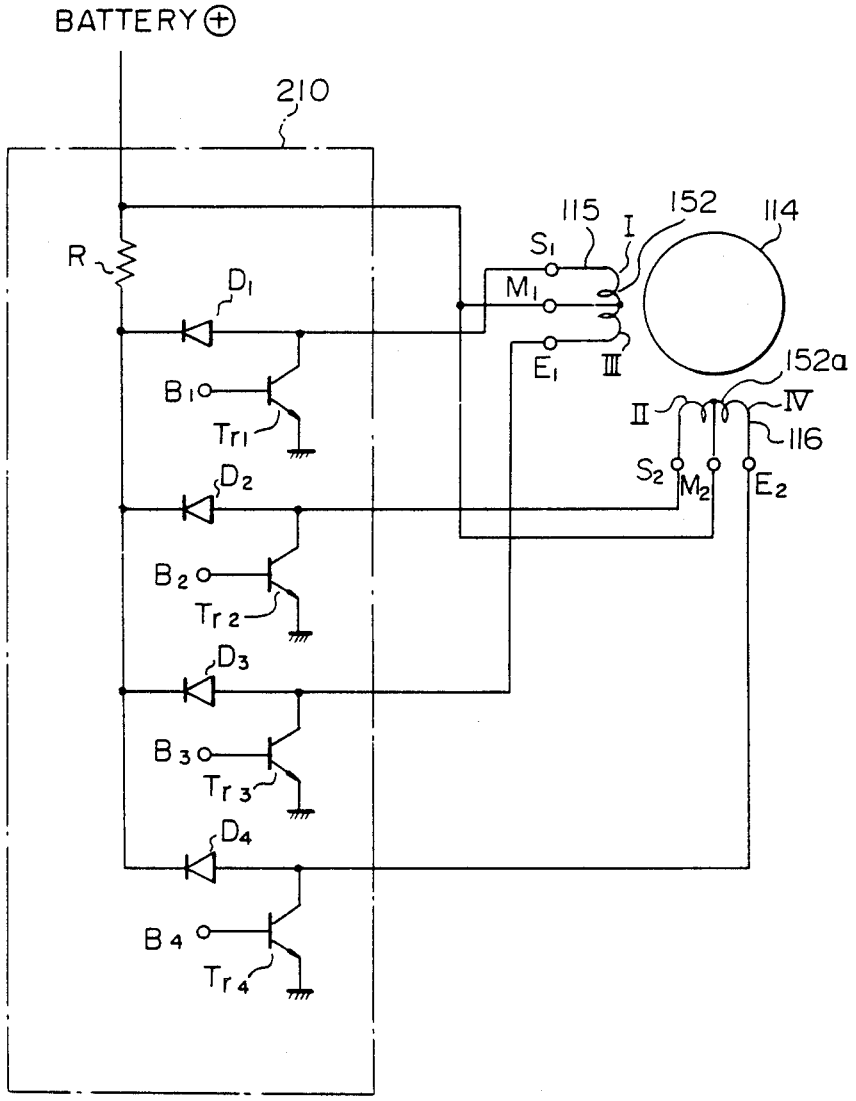
FIG. 11 is a circuit diagram of a step motor drive circuit.

FIG. 11 illustrates a circuit diagram of the step motor drive circuit 210 illustrated in FIG. 10. In FIG. 8, the stator coil 152 of the stator 115 is wound in the same direction as the winding direction of the stator coil 152*a* of the stator 116. In FIG. 11, the winding start terminals of the stator coils 152 and 152*a* of the stators 115 and 116 are indicated by $S_1$ and $S_2$, respectively, and the winding end terminals of the stator coils 152 and 152*a* of the stators 115 and 116 are indicated by $E_1$ and $E_2$, respectively. In addition, in FIG. 11, the intermediate taps of the stator coils 152 and 152*a* of the stators 115 and 116 are indicated by $M_1$ and $M_2$, respectively. In the stator 115, the stator coil 152, located between the winding start terminal $S_1$ and the intermediate tap $M_1$, constructs a first phase exciting coil I, and the stator coil 152, located betwen the winding end terminal $E_1$ and the intermediate tap $M_1$, constructs a third phase exciting coil III. In addition, in the stator 116, the stator coil 152*a*, located between the winding start terminal $S_2$ and the intermediate terminal $M_2$, constructs a second phase exciting coil II, and the stator coil 152*a*, located between the winding end terminal $E_2$ and the intermediate tap $M_2$, constructs a fourth phase exciting coil IV. As illustrated in FIG. 11, the step motor drive circuit 210 comprises four transistors $Tr_1$, $Tr_2$, $Tr_3$ and $Tr_4$, and the winding start terminals $S_1$ and $S_2$ and the winding end terminals $E_1$ and $E_2$ are connected to the collectors of the transistors $Tr_1$, $Tr_2$, and $Tr_3$ and $Tr_4$, respectively. In addition, the intermediate taps $M_1$ and $M_2$ are connected to the plus terminal of the battery (not shown). The collectors of the transistors $Tr_1$, $Tr_2$, $Tr_3$ and $Tr_4$ are connected to the plus terminal of the batter via corresponding diodes $D_1$, $D_2$, $D_3$ and $D_4$ for absorbing a surge current and via a resistor R, and the emitters of the transistors $Tr_1$, $Tr_2$, $Tr_3$ and $Tr_4$ are grounded. In addition, the bases of the transistors $Tr_1$, $Tr_2$, $Tr_3$ and $Tr_4$ are connected to the corresponding output terminals of the step motor circuit 210.

Figure 12:
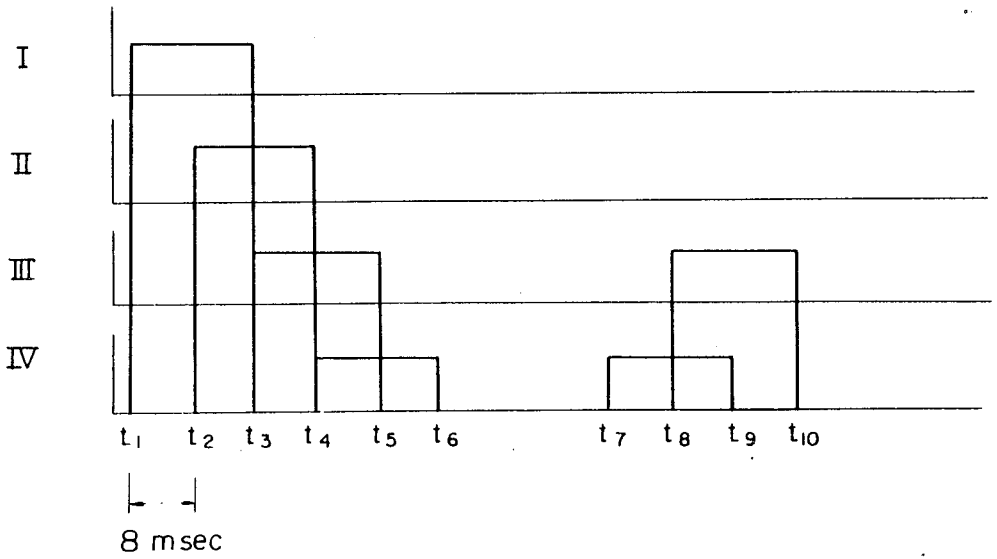
FIG. 12 is a time chart of the control pulses of a step motor.

On the other hand, a function representing a desired relationship between the temperature of the cooling water of the engine and the engine idling speed and a function representing a desired relationship between the position of the air conditioning switch and the engine idling speed are stored in the ROM 201 in the form of a formula or a data table. In the MPU 200, the rotating direction of the step motor 101, which is necessary to equalize the engine speed to a predetermined engine idling speed, is determined from the above-mentioned function and the engine speed at which the engine is now driven. In addition, step motor drive data, which is necessary to rotate the step motor 101 in a stepping manner in the above-mentioned rotating direction, is obtained. Then the step motor drive data is written in the output port 205. This writing operation of the step motor drive data is executed, for example, every 8 msec. For example, four-bit drive date "1000", indicating that only the transistor $Tr_1$ is turned on, is written in the output port 205, and the signals, "1", "0", "0", "0" are produced at the bases $B_1$, $B_2$, $B_3$, $B_4$ of the transistors $Tr_1$, $Tr_2$, $Tr_3$, $Tr_4$, respectively. As a result, since only the transistor $Tr_1$ is turned on, the first phase exciting coil I is excited. I, II, III, IV or FIG. 12 illustrate signals produced at the bases $B_1$, $B_2$, $B_3$, $B_4$, respectively. Assuming that, in the MPU 200, it is determined that the step motor 101 should be rotated by three steps in a rotating direction wherein the valve head 129 closes the annular air flow passage 131, the step motor drive data "1000", indicating that only the transistor $Tr_1$ finally is turned on before the time $t_1$ should be turned on, is written in the output port 205. Then in the time $t_2$ in FIG. 12, the step motor drive data "1100" is written in the output port 205 for rotating the step motor 101 by one step. Consequently, during the time period from the time $t_2$ to the time $t_3$, both the transistors $Tr_1$ and $Tr_2$ are turned on. Thus, the first phase exciting coil I and the second phase exciting coil II are excited. Then, at the time $t_3$, the step motor drive data "0110" is written in the output port 205. Thus, during the time period from the time $t_3$ to the time $t_4$, both the second phase exciting coil II and the third phase exciting coil III are excited. Then, at the time $t_4$, the step motor drive data "0011" is written in the output port 205. Thus, during the time period from the time $t_4$ to the time $t_5$, both the third phase exciting coil III and the fourth phase exciting coil IV are excited. Then, at the time $t_5$, the step motor drive data "0001" is written in the output port 205. Thus, during the time period from the time $t_5$ to the time $t_6$, only the fourth phase exciting coil IV is excited. Then, at the time $t_6$, the step motor drive data "0000" is written in the output port 205. Thus, all the transistors $Tr_1$, $Tr_2$, $Tr_3$, $Tr_4$ are turned off. By successively exciting the exciting coils I, II, III, IV as mentioned above, the step motor 101 is rotated by three steps.

On the other hand, at the time $t_7$, if it is determined in the MPU 200 that the step motor 101 should be rotated by one step in rotating direction wherein the valve head 129 opens the annular air flow passage 131, the step motor drive data "0001", indicating that only the transistor $Tr_4$ is turned on, is written in the output port 205. Consequently, during the time period from the time $t_7$ to the time $t_8$, only the fourth phase exciting coil IV is excited. Then, at the time $t_8$, the step motor drive data "0011" is written in the output port 205. Thus, during the time period from the time $t_8$ to the time $t_9$, both the third phase exciting coil III and the fourth phase exciting coil IV are excited. Then, at the time $t_9$, the step motor drive data "0010" is written in the output port 205. Thus, during the time period from the time $t_9$ to the time $t_{10}$, only the third phase exciting coil III is excited. Then, at the time $t_{10}$, the step motor drive data "0000" is written in the output port 205. Thus, all the transistors $Tr_1$, $Tr_2$, $Tr_3$, $Tr_4$ are turned off. By successively exciting the exciting coils IV and III as mentioned above, the step motor 101 is rotated by one step.

Figure 13:
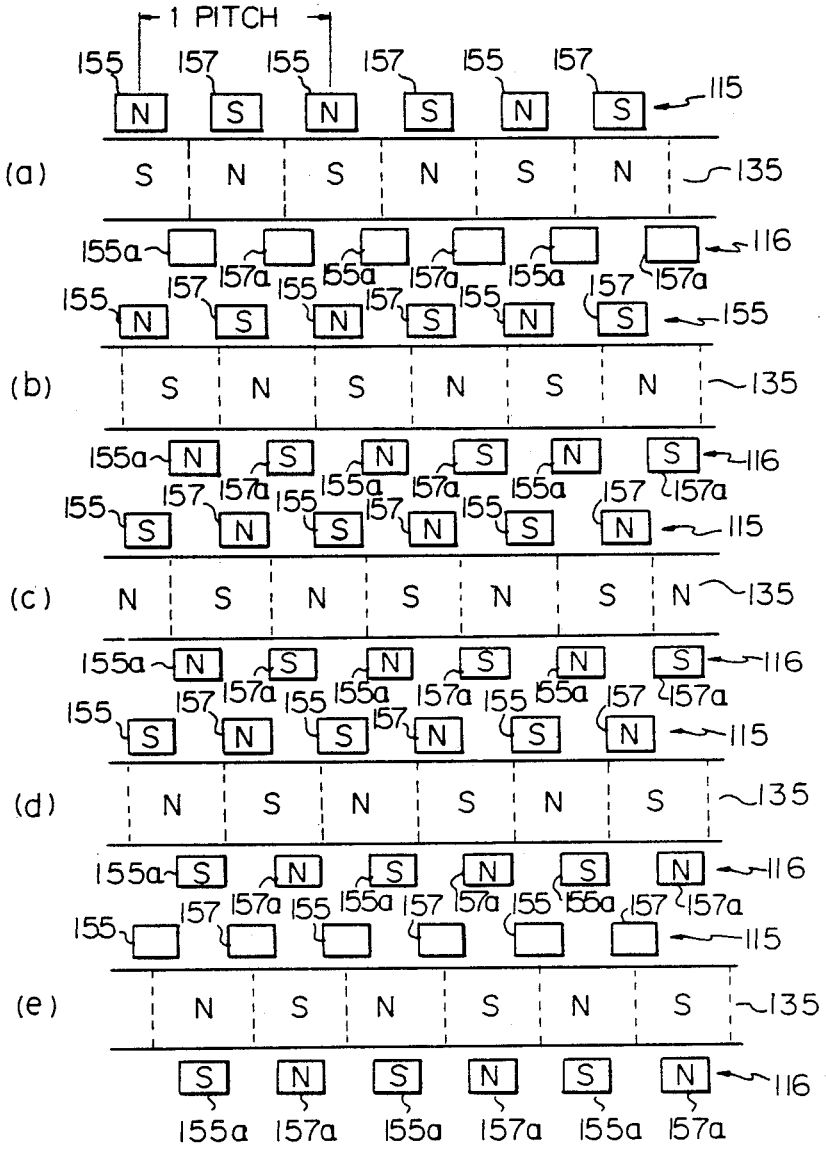
FIG. 13 is a schematically illustrative view of the stator and the rotor of a step motor.

FIG. 13 illustrates a scehmatic view of the outer circumferential surface of the hollow cylindrical outer body 135 of the rotor 114 and the pole pieces 155, 155*a*, 157, 157*a* of the stators 115, 116. In FIG. 13, (a) illustrates the case wherein only the first phase exciting coil I is excited as illustrated in FIG. 12 between the time $t_1$ and the time $t_2$. At this time, the polarity of the pole pieces 155 of the stator 115 is N, and the polarity of the pole pieces 157 of the stator 115 is S. Contrary to this, the polarity does not appear on the pole pieces 155*a*, 157*a* of the stator 116. Consequently, at this time, the rotor 114 remains stationary at a position wherein each of the pole pieces 155 of the stator 115 faces the corresponding S pole of the hollow cylindrical outer body 135 and each of the pole pieces 157 of the stator 115 faces the corresponding N pole of the hollow cylindrical outer body 135. When the second phase exciting coil II is exited, as illustrated between the time $t_2$ and the time $t_3$ in FIG. 12, since the flow direction of the current in the secondary phase exciting coil II is the same as that of the current in the first phase exciting coil I, the polarity of the pole pieces 155*a* of the stator 116 becomes N, and the polarity of the pole pieces 157*a* of the stator 116 becomes S, as illustrated in FIG. 13 (*b*). Consequently, at this time, the hollow cylindrical outer body 135 moves to a position where each of the S poles of the hollow cylindrical outer body 135 is located between the corresponding pole pieces 155 of the stator 115 and the corresponding pole pieces 155*a* of the stator 116, and each of the N poles of the hollow cyindrical outer body 135 is located between the corresponding pole pieces 157 of the stator 115 and the corresponding pole pieces 157*a* of the stator 116. Therefore, assuming that the distance between the adjacent two pole pieces 155 of the stator 115 is one pitch, as mentioned previously, the hollow cylindrical outer body 135 moves by $\frac{1}{8}$ of a pitch towards the right in FIG. 13 from the position illustrated in FIG. 13 (*a*) to the position illustrated in FIG. 13 (*b*).

After this, when the third phase exciting coil III is excited, as illustrated between the time $t_3$ and the time $t_4$ in FIG. 12, since the flow direction of the current in the third phase exciting coil III is opposite to that of the current in the first phase exciting coil I, the polarity of the pole pieces 155 of the stator 115 becomes S, and the polarity of the pole pieces 157 of the stator 115 becomes N as illustrated in FIG. 13 (*c*). As a result of this, the hollow cylindrical outer body 135 moves by $\frac{1}{4}$ of a pitch towards the right in FIG. 13 from the position illustrated in FIG. 13 (*b*) to the position illustrated in FIG. 13 (*c*). In the same manner as described above, when the fourth phase exciting coil IV is excited, as illustrated between the time $t_4$ and the time $t_5$ in FIG. 12, the hollow cylindrical outer body 135 moves by 174 of a pitch towards the right in FIG. 13 from the position illustrated in FIG. 13 (*c*) to the position illustrated in FIG 13 (*d*). After this, during the time period from the time $t_5$ to the time $t_6$, only the fourth phase exciting coil IV is excited. Thus, the polarity does not appear on the pole pieces 155, 157 of the stator 115 as illustrated in FIG. 13 (*e*). Consequently, at this time, the hollow cylindrical outer body 135 moves by a $\frac{1}{8}$ of a pitch towards the right in FIG. 13 from the position illustrated in FIG. 13 (*d*) to the position illustrated in FIG. 13 (*e*) so that each of the pole pieces 155*a* of the stator 116 faces the corresponding N pole of the hollow cylindrical outer body 135 and each of the pole pieces 157*a* of the stator 116 faces the corresponding S pole of the hollow cylindrical body 135. Then, at the time $t_6$ in FIG. 12, all the transistors $Tr_1$, $Tr_2$, $Tr_3$, $Tr_4$ are turned off. Thus, the exciting operation of all the exciting coils I, II, III, IV is stopped. At this time, as illustrated in FIG. 13 (*e*), each of the pole pieces 155*a* of the stator 116 faces the corresponding N pole of the hollow cylindrical outer body 135 and each of the pole pieces 157*a* of the stator 116 faces the corresponding S pole of the hollow cylindrical outer body 135. Consequently, the hollow cylindrical outer body 135 is kept stationary at the position illustrated in FIG. 13 (*e*) due to the attracting forces of the N pole and the S pole of the hollow cyindrical outer body 135, which forces act on the pole pieces 155*a* and the pole pieces 157*a* of the stator 116, respectively.

When only the fourth phase exciting coil IV is again excited as illustrated between the time $t_7$ and the time $t_8$ in FIG. 12, since the hollow cylindrical outer body 135 is located in the position illustrated in FIG. 13 (*e*), the hollow cylindrical outer body 135 remains stationary. After this, when the third phase exciting coil III is excited as illustrated between the time $t_8$ and the time $t_9$ in FIG. 12, the polarities, as illustrated in FIG. 13 (*d*), appear on the pole pieces 155, 155*a*, 157, 157*a* of the stators 115, 116. Thus, the hollow cylindrical outer body 135 moves by 150 of a pitch towards the left in FIG. 13 from the position illustrated in FIG. 13 (*e*) to the position illustrated in FIG. 13 (*d*).

As illustrated between the time $t_1$ and the time $t_6$ in FIG. 12, when the exciting coils I, II, III, IV are successively excited from the first phase exciting coil I to the fourth phase exciting coil IV, the hollow cylindrical outer body 135 of the rotor 114 moves relative to the stators 115, 116. Accordingly, the rotor 114 rotates in one direction. When the rotor 114 rotates, since the external screw threads 122 of the valve shaft 113 is engaged with the internal screw threads 140 of the hollow cylindrical inner body 133, as illustrated in FIG. 2, the valve shaft 113 is caused to move in one direction, for example, towards the left in FIG. 2. As a result of this, since the cross-sectional area of the annular air flow passage 131 formed between the valve head 129 and the valve seat 112 is increased, in FIG. 1, the amount of air fed via the air conduit 18 into the surge tank 14 from the intake duct 13 located upstream of the throttle valve 16 is increased. Contrary to this, during the time period between the time $t_7$ and the time $t_{10}$ in FIG. 12, since the valve shaft 113 is caused to move towards the right in FIG. 2, the cross-sectional area of the annular air flow passage 131 formed between the valve head 129 and the valve seat 112 is reduced.

Figure 14:
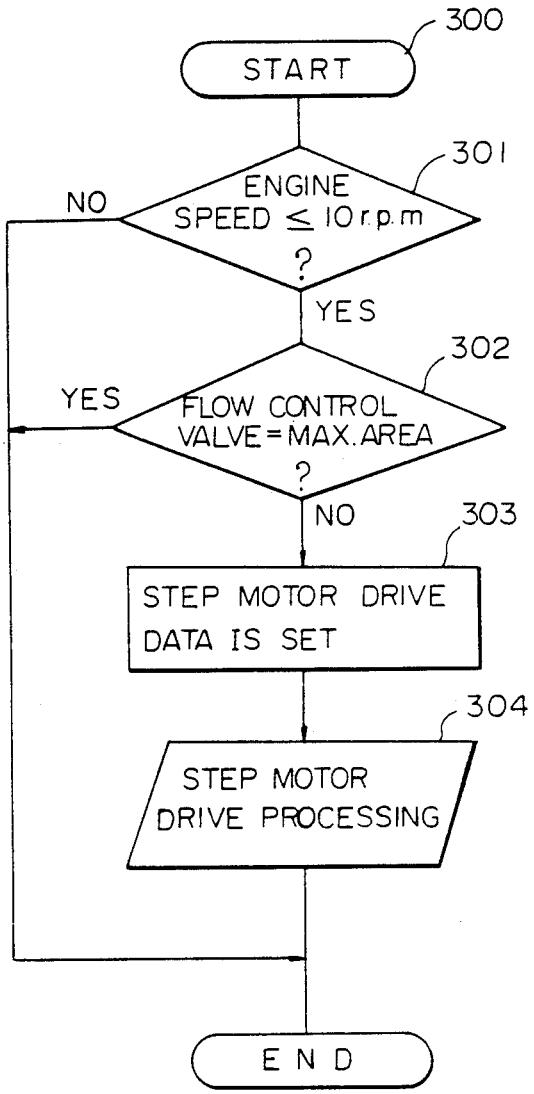
FIG. 14 is a flow chart illustrating the operation of an embodiment according to the present invention.

FIG. 14 illustrates a flow chart of an idling speed control operation which is executed by the MPU 200 for controlling the amount of air flowing within the bypass pipe 108 so that it becomes maximum when the engine is stopped. In FIG. 14, the routine, indicated by step 300, is processed by sequential interruptions which are executed periodically every 8 msec. If the processing cycle is started, initially, in step 301, the output signal of the pickup 22 (FIG. 1) is input into the electronic control unit 20, and in the MPU 200, the engine speed is calculated. Then, it is determined whether the engine speed is not larger than 10 r.p.m. This determination is executed for determining whether the engine will be stopped or not. If the engine speed is not larger than 10 r.p.m., the routine goes to step 302, and it is determined whether the valve head 129 of the step motor 101 (FIG. 2) is in the maximum open position or not. If the valve head 129 is in the maximum open position, the step motor 101 remains stationary. Contrary to this, if the valve head 129 is not in the maximum open position, the routine goes to step 303. In step 303, data, indicating that the step motor 101 should be rotated by one step in a direction where the valve head 129 opens, is stored in predetermined address in the RAM 202. Then, in step 304, the data, stored in the RAM 202, is written in the outer port 205. Thus, the step motor 101 is rotated by one step in a direction where the valve head 129 opens. The routine goes to step 303, 304 as long as the engine speed is not larger than 10 r.p.m. Therefore, the step motor 101 is sucessively rotated by one step in a direction where the valve head 129 opens until the valve head 129 reaches the maximum open position.

As mentioned above, when the engine speed is not larger than 10 r.p.m., that is, immediately before the engine stops, the steps motor 101 is controlled so that the valve head 129 reaches the maximum opening position. Consequently, when the engine is started again, since the amount of air flowing within the bypass pipe 108 is maintained at the maximum, a good starting operation of the engine can be obtained.

Figure 15:
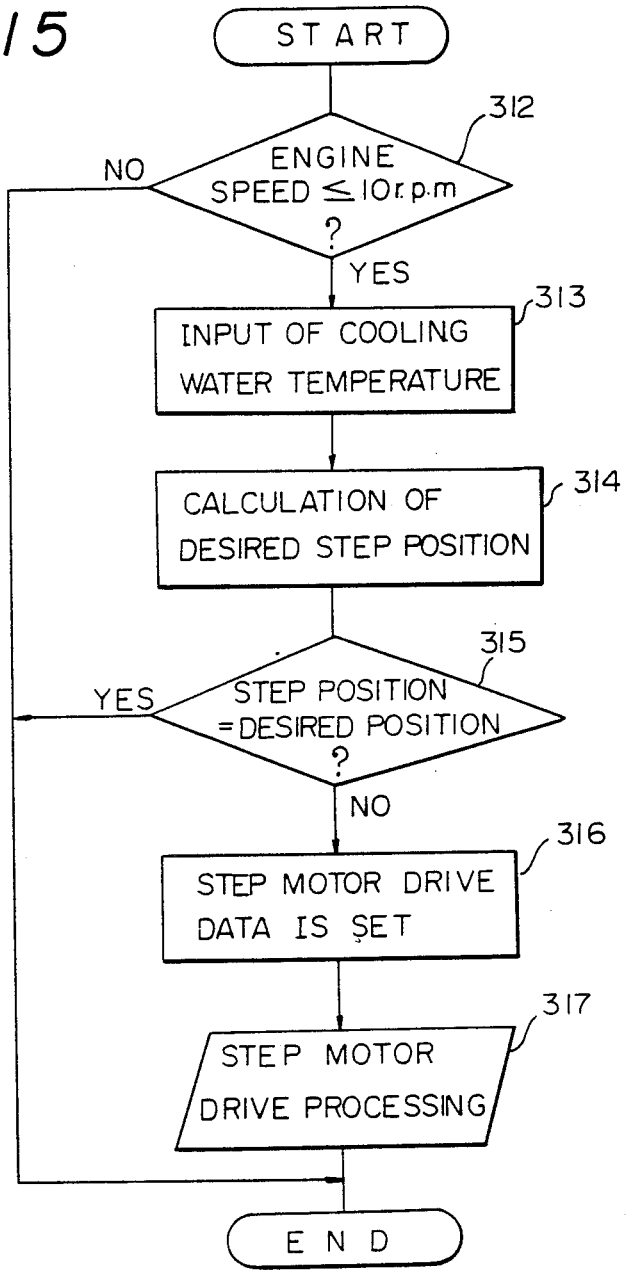
FIG. 15 is a flow chart illustrating the operation of an alternative embodiment according to the present invention.
Figure 16:
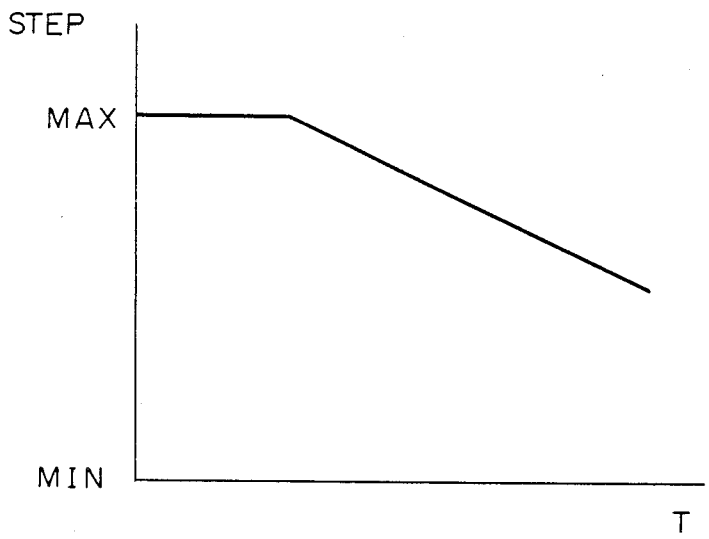
FIG. 16 is a diagram illustrating the relationship between the step position of a step motor and the temperature of the cooling water of an engine.

FIG. 15 illustrates an alternative embodiment of a flow chart for controlling the amount of air flowing within the bypass pipe 108 so that is becomes an amount determined by the cooling water temperature. In this embodiment, initially, in step 312, it is determined whether the engine speed is not larger than 10 r.p.m. When the engine speed is not larger than 10 r.p.m, the routine goes to step 313. In step 313, the output signal (THW) of the cooling water temperature sensor (FIG. 10) is input into the MPU 200. Then, in step 314, the desired step position of the step motor 101 is calculated from the relationship illustrated in FIG. 16 on the basis of the output signal (THW) of the cooling water temperature sensor. In FIG. 16, the ordinate STEP indicates the desired step position of the step motor 101, and the abscissa T indicates the cooling water temperature. In addition, the MAX of the ordinate STEP indicates a step position where the valve head 129 opens to the maximum extent, and the MIN indicates a step position where the valve head 129 closes. The relationship illustrated in FIG. 16 is stored in the ROM 201 in the form of a formular or a data table. Then, in step 315, it is determined whether the present step position of the step motor 101 is equal to the desired step position STEP. If the present step position of the step motor 101 is equal to the desired step position STEP, the step motor 101 is retained stationary. Contrary to this, if it is determined in step 315 that the present step position of the step motor 101 is not equal to the desired step position STEP, the routine goes to step 316. In step 316, data, indicating that the step motor 101 should be rotated by one step in a direction where the step position of the step motor 101 approaches the desired step position STEP, is obtained and then stored in a predetermined address in the RAM 202. Then, in step 317, the step motor 101 is rotated in accordance with the data stored in the RAM 202. Thus, the step motor 101 is rotated until the step position thereof becomes equal to the desired step position STEP. As will be understood from the above description, in this embodiment, when the engine is stopped, the valve head 129 is actuated until the flow area of the valve head 129 becomes equal to the desired flow area determined by the cooling water temperature and suited for starting the engine again. Therefore, it is possible to easily start the engine again.

In this embodiment, the desired flow area of the valve head 129 is determined by the cooling water temperature as mentioned above. However, instead of determining the desired flow area as mentioned above, the desired flow area of the valve head 129 may be determined by any other engine parameter.

In addition, the present invention has been described hereinbefore with reference to the embodiments in which the step motor is used for controlling the amount of air flowing within the bypass pipe 108. However, instead of using the step motor, any other drive means such as a linear solenoid may be used for controlling the amount of air flowing within the bypass pipe 108.

According to the present invention, by using a step motor or a linear solenoid for controlling the amount of air flowing within the bypass pipe, the controllable range of the air flow area of the bypass pipe can be increased, and the air flow area of the bypass pipe can be precisely controlled. Therefore, it is possible to easily start the engine again after the engine is stopped.

While the invention has been described by reference to specific embodiments chosen for the purpose of illustration, it should be apparent that numerous modifications can be made thereto by those skilled in the art without departing from the basic concept and scope of the invention.

We claim:

1. An idle speed controlling device for an internal combustion engine comprising:

a main intake passage;

a throttle valve arranged in said main intake passage;

a bypass passage branched off from said main intake passage upstream of said throttle valve and connected to said main intake passage upstream of said valve and connected to said main intake passage downstream of said throttle valve;

a control valve arranged in said bypass passage;

a step motor connected to said control valve and having a plurality of step positions which are changed in accordance with the rotating motion of said step motor;

speed sensor means for detecting an engine speed to produce an output signal indicating the engine speed; and control means for determining whether the engine speed is reduced below a predetermined speed which causes the engine to stop on the basis of the output signal of said speed sensor means and actuating said step motor until the step position of step motor reaches a maximum extent when the engine speed is lower than said predetermined speed, and said step motor being actuated to position said control valve to a given position when the engine speed is greater than or equal to said predetermined speed.

2. An idle speed controlling device for an internal combustion engine comprising:

a main intake passage;

a throttle valve arranged in said main intake passage;

a bypass passage branched off from said main intake passage upstream of said throttle valve and connected to said main intake passage downstream of said throttle valve;

a control valve arranged in said bypass passage;

a step motor connected to said control valve and having a plurality of step positions which are changed in accordance with the rotating motion of said step motor;

speed sensor means for detecting an engine speed to produce an output signal indicating the engine speed;

coolant temperature detecting means for detecting a coolant temperature to produce an output signal indicating the coolant temperature; and control means for determining whether the engine speed is reduced below a predetermined speed which causes the engine to stop on the basis of the output signal of said speed sensor means and actuating said step motor in response to the output signal of said coolant temperature detecting means until the step position of said step motor reaches a step position determined by the coolant temperature when the engine speed is lower than said predetermined speed, and said step motor being actuated to position said control valve to a given position when the engine speed is greater than or equal to said predetermined speed.

3. A device for controlling the idling speed of an engine comprising a main intake passage, a throttle valve arranged in the main intake passage, a bypass passage branching off from the main intake passage upstream of the throttle valve and being connected to the main intake passage downstream of the throttle valve, and a control valve arranged in the bypass passage, said device comprising:

means for actuating the control valve to control the flow area of the bypass passage;

first means for detecting an engine speed to produce an output signal indicating the engine speed;

second means for detecting the operating condition of the engine to produce an output signal indicating that the engine is idling; and control means controlling said actuating means to actuate the control valve in response to the output signals of said first means and said second means for equalizing the flow area of the bypass passage to a predetermned desired flow area when the engine speed is reduced below a predetermined speed which causes the engine to stop, said control valve being actuated to a specific given position when the engine speed is greater than or equal to said predetermined speed.

4. A device according to claim 3, wherein said desired flow area is a maximum flow area of the bypass passage.

5. A device according to claim 3, wherein said desired flow area is a flow area which is determined by an operation parameter of the engine.

6. A device according to claim 5, wherein said operation parameter is a cooling water temperature of the engine.

7. A device according to claim 3, wherein said predetermined speed is about 10 r.p.m.

8. A device according to claim 3, wherein said actuating means comprises a step motor connected to the control valve and having a plurality of step positions which are changed in accordance with the rotating motion of said step motor, said control means producing a step motor drive signal for rotating said step motor until the step position of said step motor becomes equal to a desired step position corresponding to said desired flow area when the engine speed is reduced below the predetermined speed.

* * * * *